US008191314B2

(12) United States Patent
Grimaldi

(10) Patent No.: US 8,191,314 B2
(45) Date of Patent: Jun. 5, 2012

(54) DOOR OR WINDOW WITH WATERTIGHT SEALING MECHANISM

(75) Inventor: Michele Grimaldi, Piossasco (IT)

(73) Assignee: Opacmare S.p.A., Turin (IT)

( * ) Notice: Subject to any disclaimer, the term of this patent is extended or adjusted under 35 U.S.C. 154(b) by 1050 days.

(21) Appl. No.: 12/094,174

(22) PCT Filed: Nov. 20, 2006

(86) PCT No.: PCT/IB2006/054336

§ 371 (c)(1),
(2), (4) Date: May 19, 2008

(87) PCT Pub. No.: WO2007/057867

PCT Pub. Date: May 24, 2007

(65) Prior Publication Data

US 2008/0295413 A1 Dec. 4, 2008

(30) Foreign Application Priority Data

Nov. 21, 2005 (EP) ..... 05425823

(51) Int. Cl.
*E05D 15/10* (2006.01)

(52) U.S. Cl. ..... 49/216; 49/114; 49/208; 49/209; 49/217; 49/218; 49/316; 49/317; 49/318; 49/320; 49/321

(58) Field of Classification Search ..... 49/208, 49/209, 216, 218, 221, 114, 316, 317, 318, 49/320, 321

See application file for complete search history.

(56) References Cited

U.S. PATENT DOCUMENTS

| | | | | |
|---|---|---|---|---|
| 2,248,719 | A * | 7/1941 | Owen | 49/25 |
| 2,766,860 | A * | 10/1956 | Travis | 49/318 |
| 3,660,936 | A | 5/1972 | Bryson | |
| 5,542,213 | A * | 8/1996 | Freeman | 49/221 |
| 5,549,068 | A | 8/1996 | Freeman et al. | |
| 6,640,498 | B1 | 11/2003 | Groeneveld | |
| 7,624,539 | B2 * | 12/2009 | Speyer et al. | 49/484.1 |

FOREIGN PATENT DOCUMENTS

WO 2005/095744 A1 10/2005

* cited by examiner

*Primary Examiner* — Katherine W Mitchell
*Assistant Examiner* — Clarence W Mayott, III
(74) *Attorney, Agent, or Firm* — Sughrue Mion, PLLC

(57) ABSTRACT

A door including a main frame, a wing and a sealing apparatus which is interposed between main frame and wing when the door is in the closed condition. The sealing apparatus including a gasket extending along the main frame and a movable sealing member supported by the main frame, and exerting a compressive force on the gasket against the wing when the door is in the closed condition. An operating device moves the movable sealing member between an activated position, in which the movable member exerts the compressive force on the gasket, and a disabled condition, in which the movable member removes the compressive force from the gasket. The movable sealing member comprises a sealing counter-frame which extends along the whole perimeter of the main frame and is movable with respect to the wing when the door is in the closed condition, in a direction perpendicular to the door.

4 Claims, 11 Drawing Sheets

DOOR OR WINDOW WITH WATERTIGHT SEALING MECHANISM

The present invention relates to doors or windows intended to be fitted to apertures formed in the walls of rooms, particularly those of rooms present in a ship.

It is known that certain shipping regulations require that some external doors of ocean-going ships should meet particular requirements in respect of their watertightness. The wings of these doors are therefore generally provided with fixed gaskets. These gaskets are placed around the frame of each wing in such a way that, when the wings are closed on to the main door frame, they create a watertight seal between the wing frames and the main door frame, and between the frame of one wing and the frame of the wing adjacent to it.

More in particular, the present invention relates to a door or window having the characteristics defined in the preamble to Claim 1. Doors or windows of this type are disclosed for example in U.S. Pat. No. 5,542,213 A, U.S. Pat. No. 3,660,936 A and WO 2005/095744 A. These documents have in common the fact that they disclose a watertight door having a wing which, when the door is in the closed position, can come still closer to the main door frame in order to reach a watertight condition.

The present invention is intended to improve sealing performance in the doors and windows, with particular relevance to the doors and windows used in shipping.

The object of the invention is therefore a door or window having the characteristics defined in Claim 1.

A door or window configured in this way makes it possible to provide doors with a watertight seal, whose sealing can be made even more efficient if desired, so that these doors can even withstand extreme sailing conditions.

Preferred embodiments are described in the dependent claims.

These and other objects and advantages will be made clearer by the following detailed description of a preferred, but not restrictive, embodiment of the invention, provided with reference to the attached drawings, in which.

Figure 1:
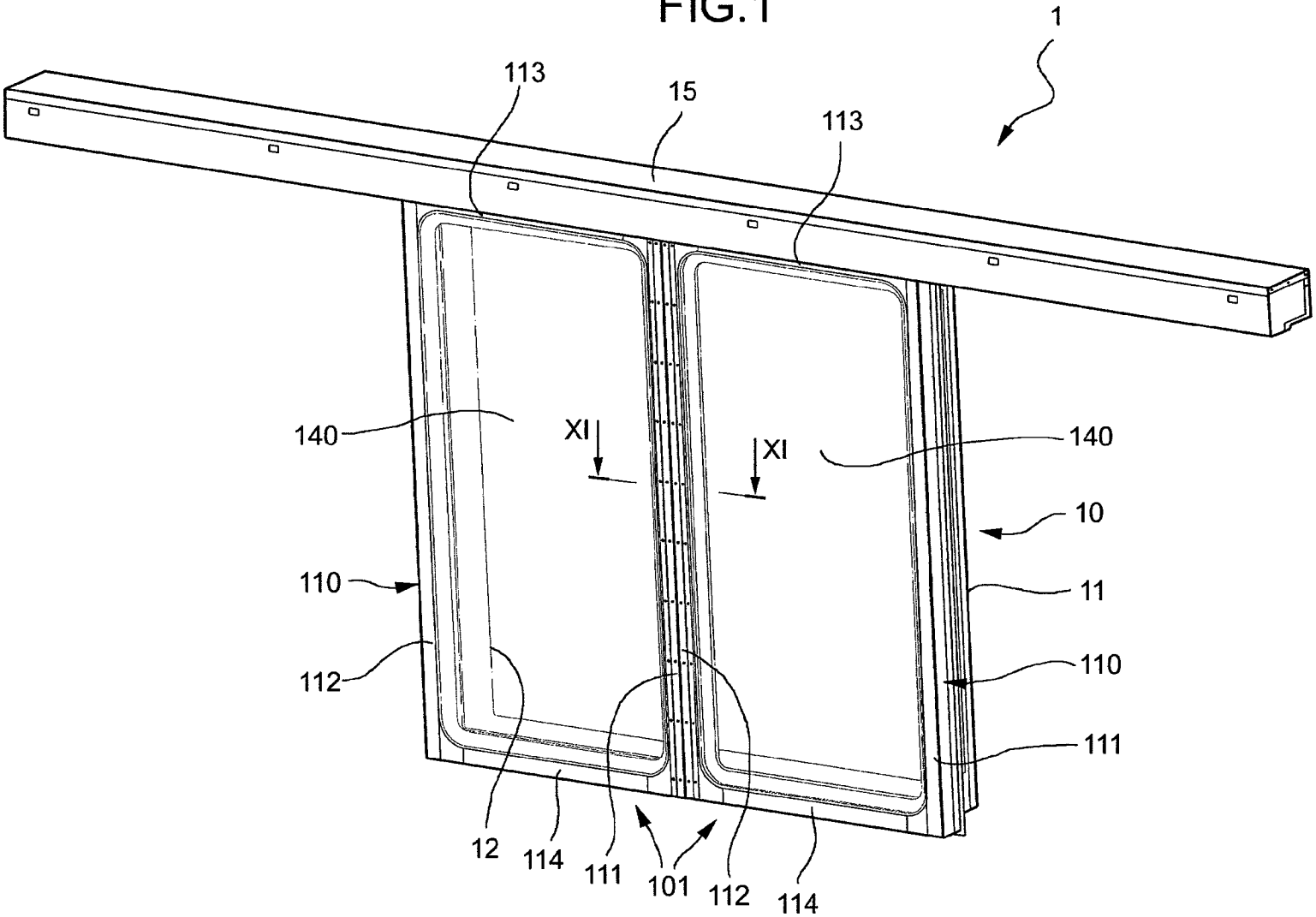
FIG. 1 is a perspective view from the front of a door according to the present invention.
Figure 2:
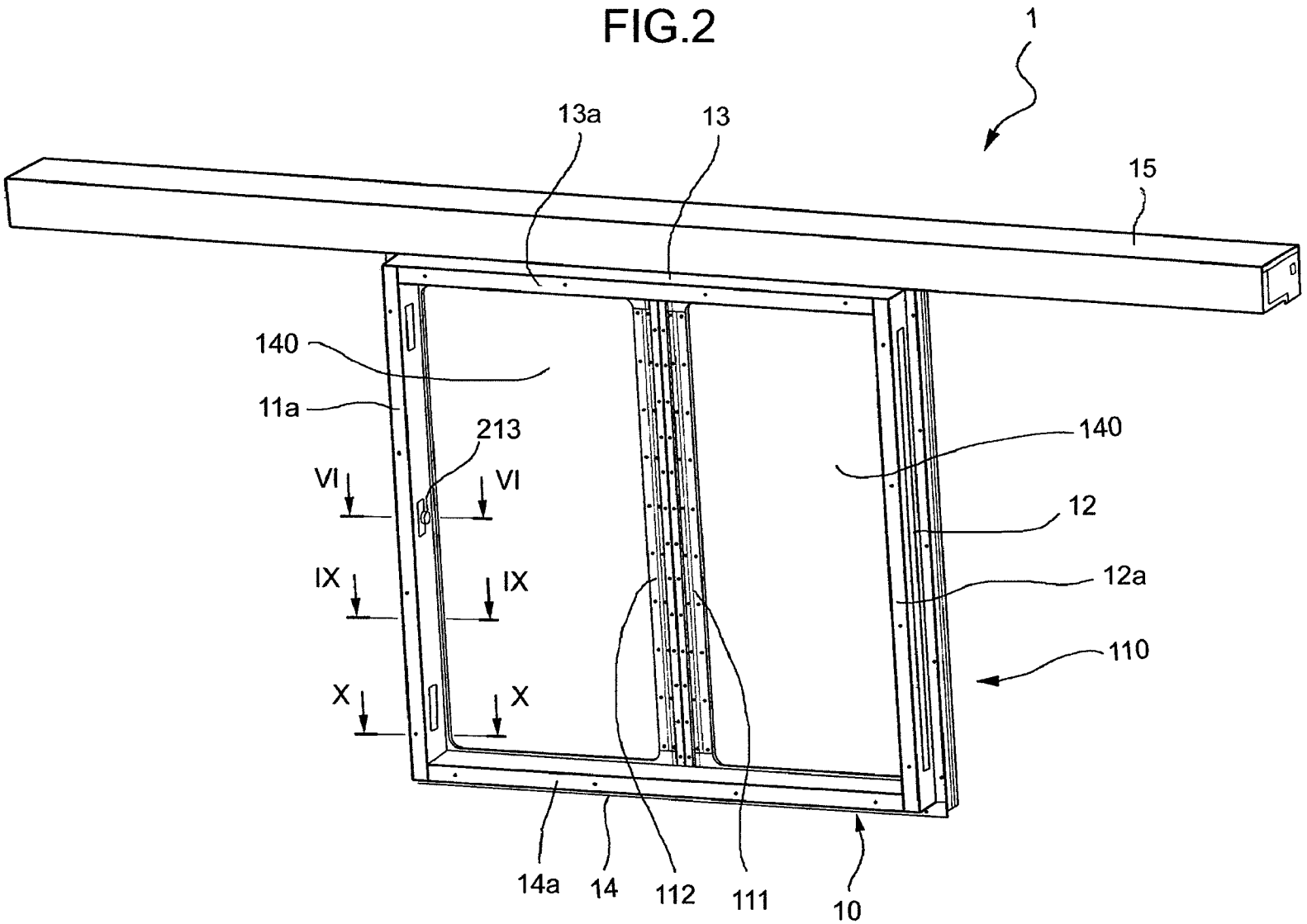
FIG. 2 is a perspective view from the rear of the door of FIG. 1.
Figure 3:
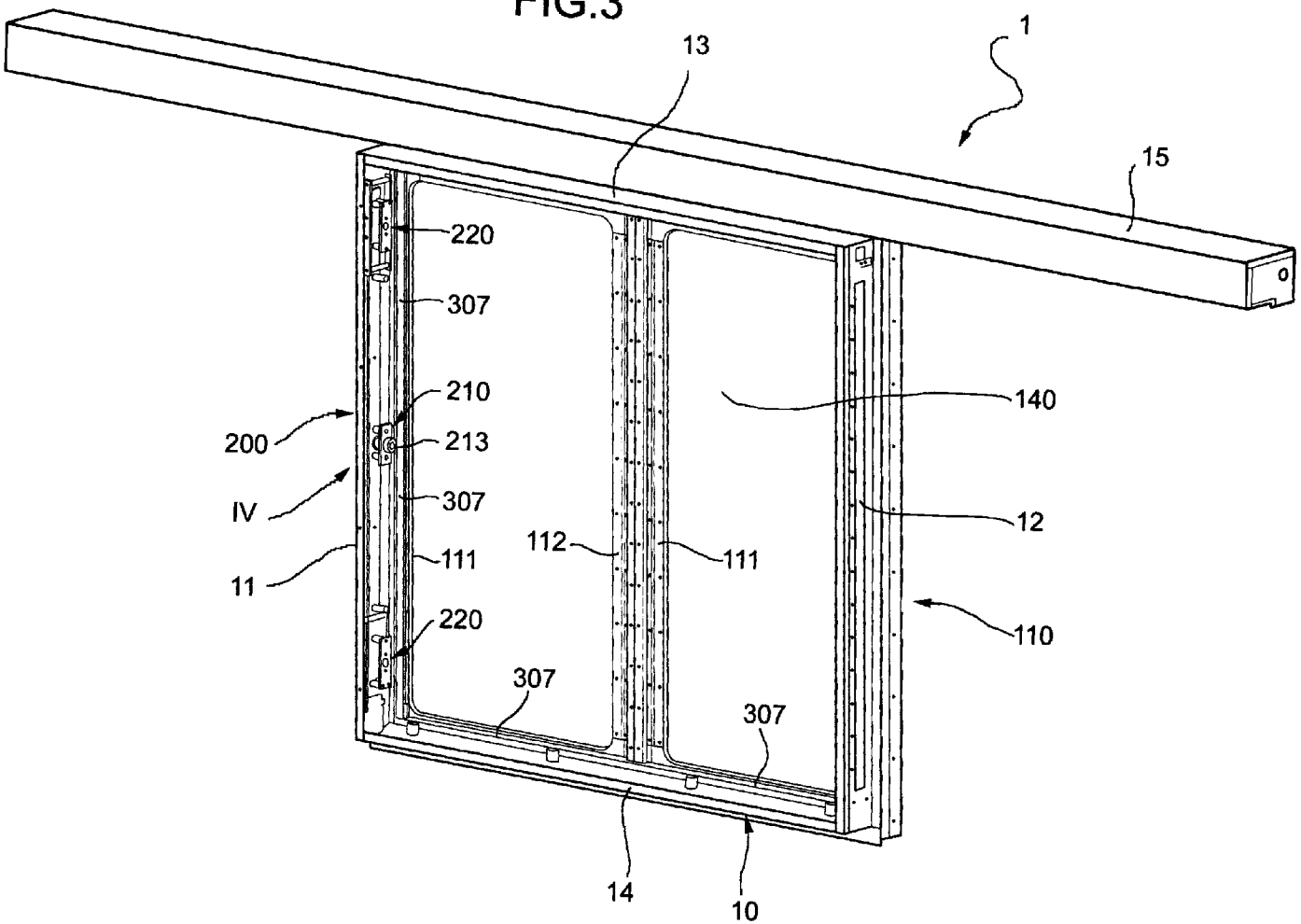
FIG. 3 is a view similar to that of FIG. 2, in which the door is shown without a covering.

With reference to FIGS. 1 to 3, these show an example of a door, indicated as a whole by the number 1, made in the form of a glazed door having two slidable wings, for fitting to a wall of a room of a ship.

The door 1 comprises a main frame 10, for fitting to the aforesaid wall (not shown) in such a way as to surround an aperture formed in this wall. The main frame 10 comprises a pair of vertical elements or uprights 11, 12, and a pair of horizontal elements or cross-members 13, 14, shown in FIGS. 3 and 4, which interconnect the uprights 11, 12 at their opposite ends.

The top cross-member 13 is connected to a transverse housing element 15, in which are positioned guides (not shown) for the sliding of the movable wings, and a conventional movement mechanism (not shown) for causing the movement of these wings.

The uprights 11, 12 and the cross-members 13, 14 have substantially box-shaped cross sections, and have covering elements 11*a*, 12*a* and 13*a*, 14*a* respectively on their rear sides, in other words on the sides facing the inside of the room.

The door frame 1 also comprises a pair of movable wings 101, which in the illustrated example are slidable with respect to the main frame 10. Each of these movable wings 101 comprises a secondary frame 110, which can be fitted slidably to the main frame 10. The secondary frame 110 also comprises a pair of vertical elements or uprights 111, 112 and a pair of horizontal elements or cross-members 113, 114, which interconnect these uprights 111, 112 at opposite ends.

The uprights 111 and 112 and the cross-members 113 and 114 of each wing have a substantially box-shaped cross section, and are designed to allow a sheet 140 of transparent or translucent material, for example glass, to be fitted, by gluing for example.

The specific general structure of the main frame 10, the secondary frames 110 of the wings 101, the housing element 15, the guides and the mechanism for moving the wings 101 is known and is not essential for the purposes of the invention, and will not be described further.

FIG. 3 shows a rear view of the door 1, from which the covering elements 11*a*, 12*a*, 13*a* and 14*a* have been removed. This reveals a watertight sealing mechanism 200, which is fitted inside each of the uprights 11 and 12 of the main frame 10. The figures show only the watertight sealing mechanism 200 associated with the upright indicated by 11, and for the sake of simplicity the following description will refer only to this mechanism.

Figure 4:
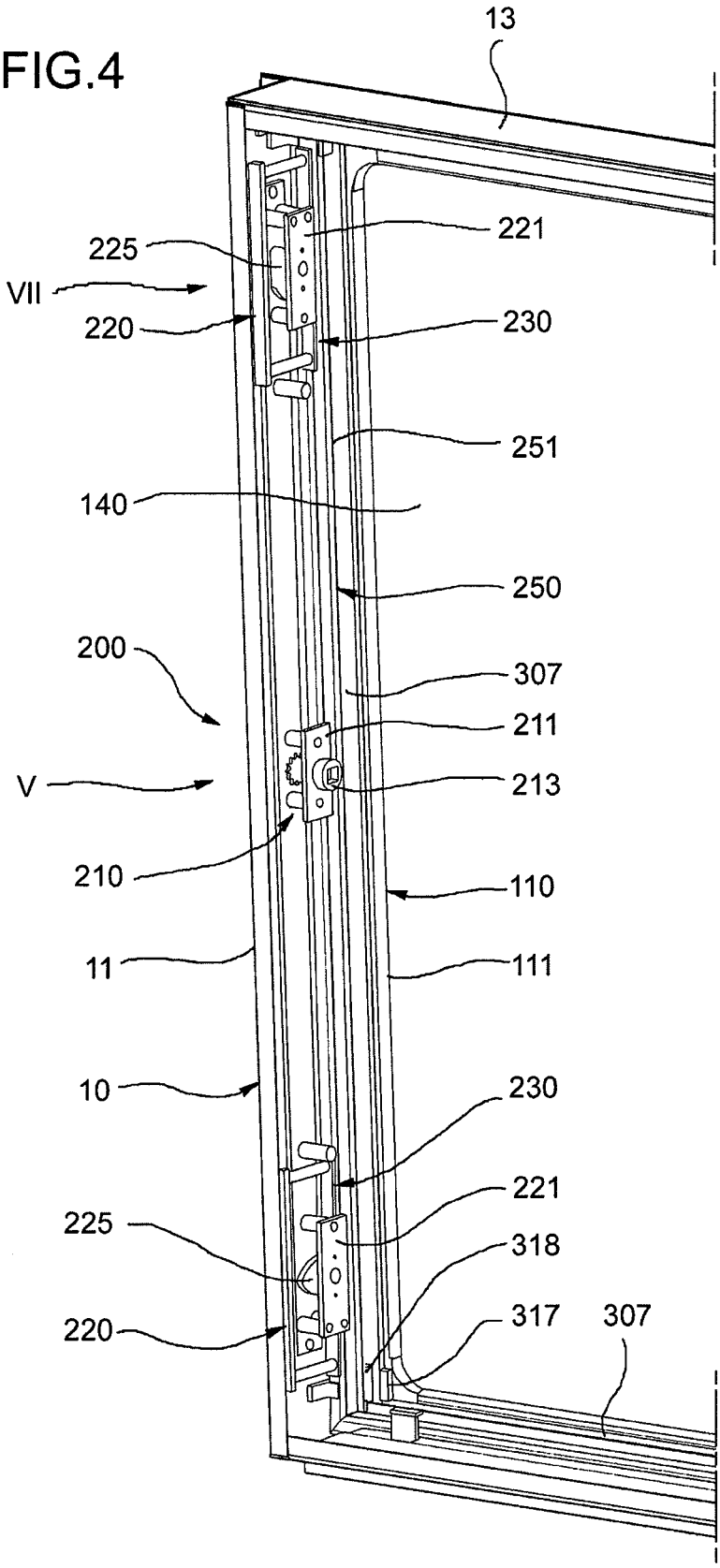
FIG. 4 is an enlarged view of a detail of FIG. 3, indicated by the arrow IV in the latter figure.

The watertight sealing mechanism 200 according to the invention is shown more clearly in FIG. 4. It essentially comprises an operating device 210, placed in an intermediate position along the length of the upright 11, and a pair of driving devices 220 placed at the ends of the upright 11.

Figure 5:
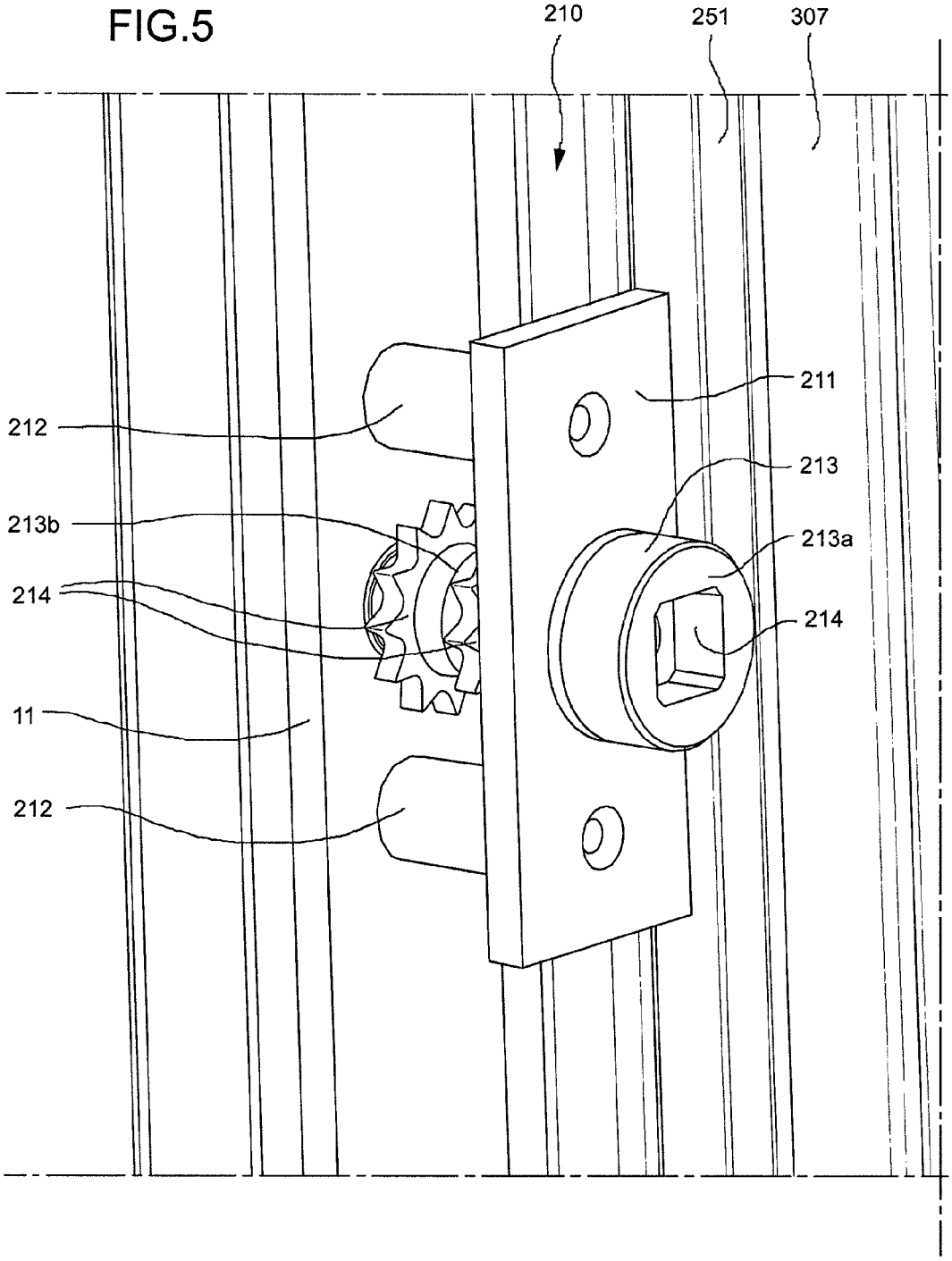
FIG. 5 is an enlarged view of a detail of FIG. 4, indicated by the arrow V in the latter figure.
Figure 6:
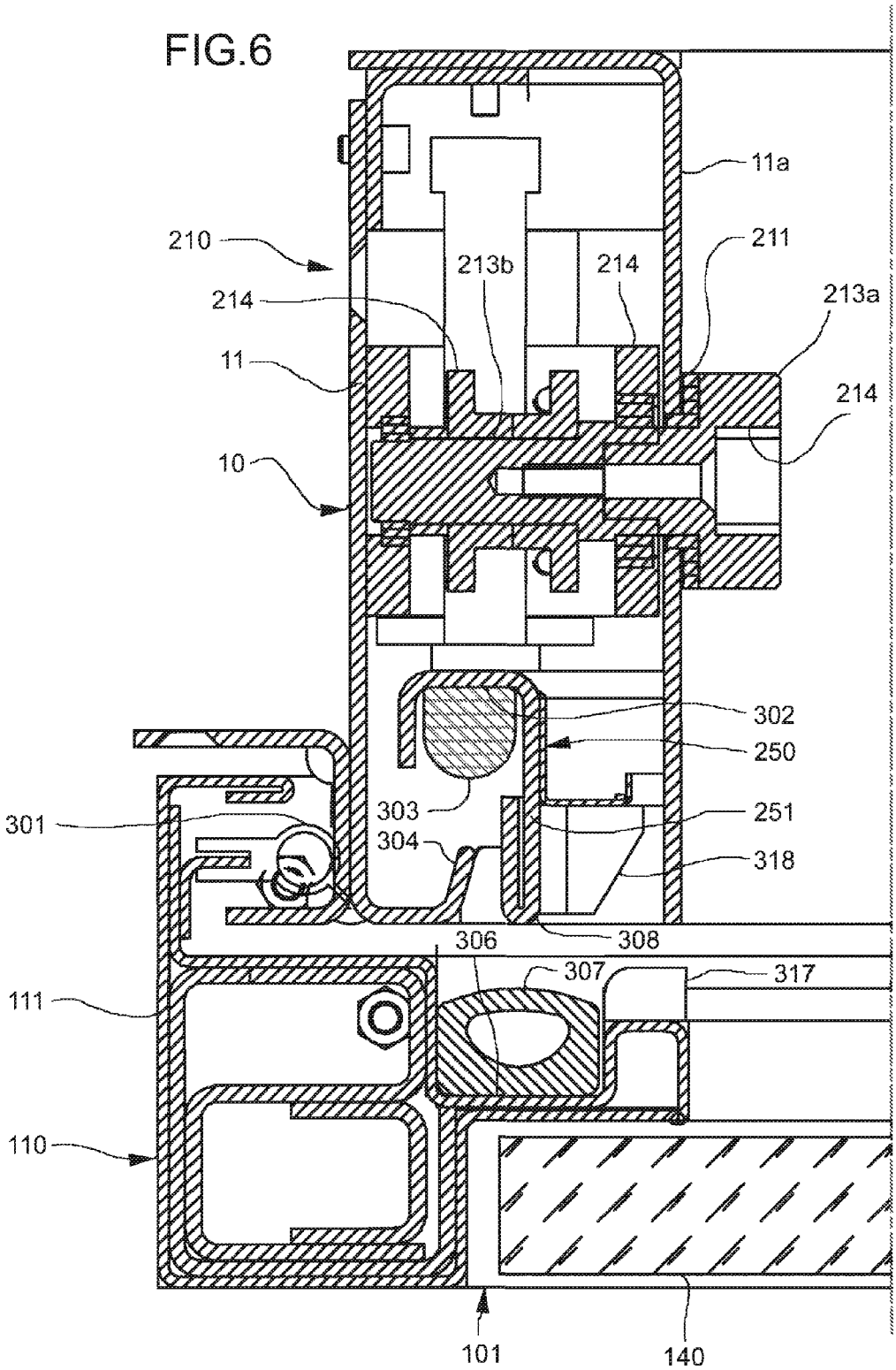
FIG. 6 is a sectional view of a detail of the door frame of FIG. 2, taken along the line VI-VI of the latter figure.

With reference to FIG. 5, the operating device 210 substantially comprises a support plate 211, which is connected in a fixed way to the upright 11, by means of connecting columns 212. A rotatable member 213, which has a head 213*a* and a shaft 213*b*, is fitted on this support plate 211. FIG. 6 shows a horizontal cross section of FIG. 5, passing through the axis of rotation of the shaft 213*b*. Two identical sprockets 214 are keyed on this shaft 213*b*. The head 213*a* of the rotatable member 213 has a recess 214 for receiving an operating key (not shown) having a cross section matching the shape of the recess, which is square for example.

Each of the sprockets 214 is connected for operation, by means of a chain transmission member (not shown), to the corresponding driving device 220.

Figure 7:
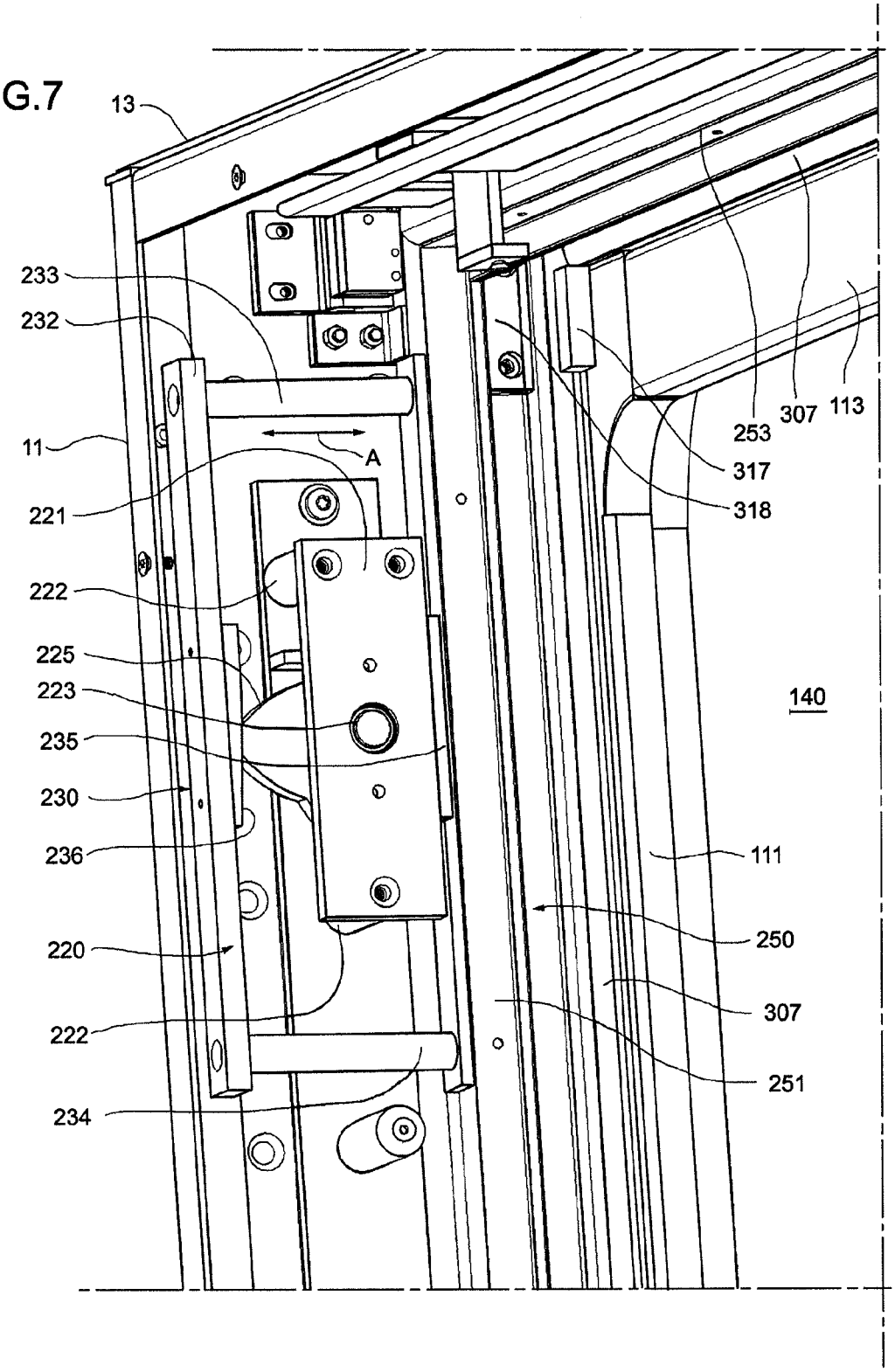
FIG. 7 is an enlarged view of a detail of FIG. 4, indicated by the arrow VII in the latter figure.
Figure 8:
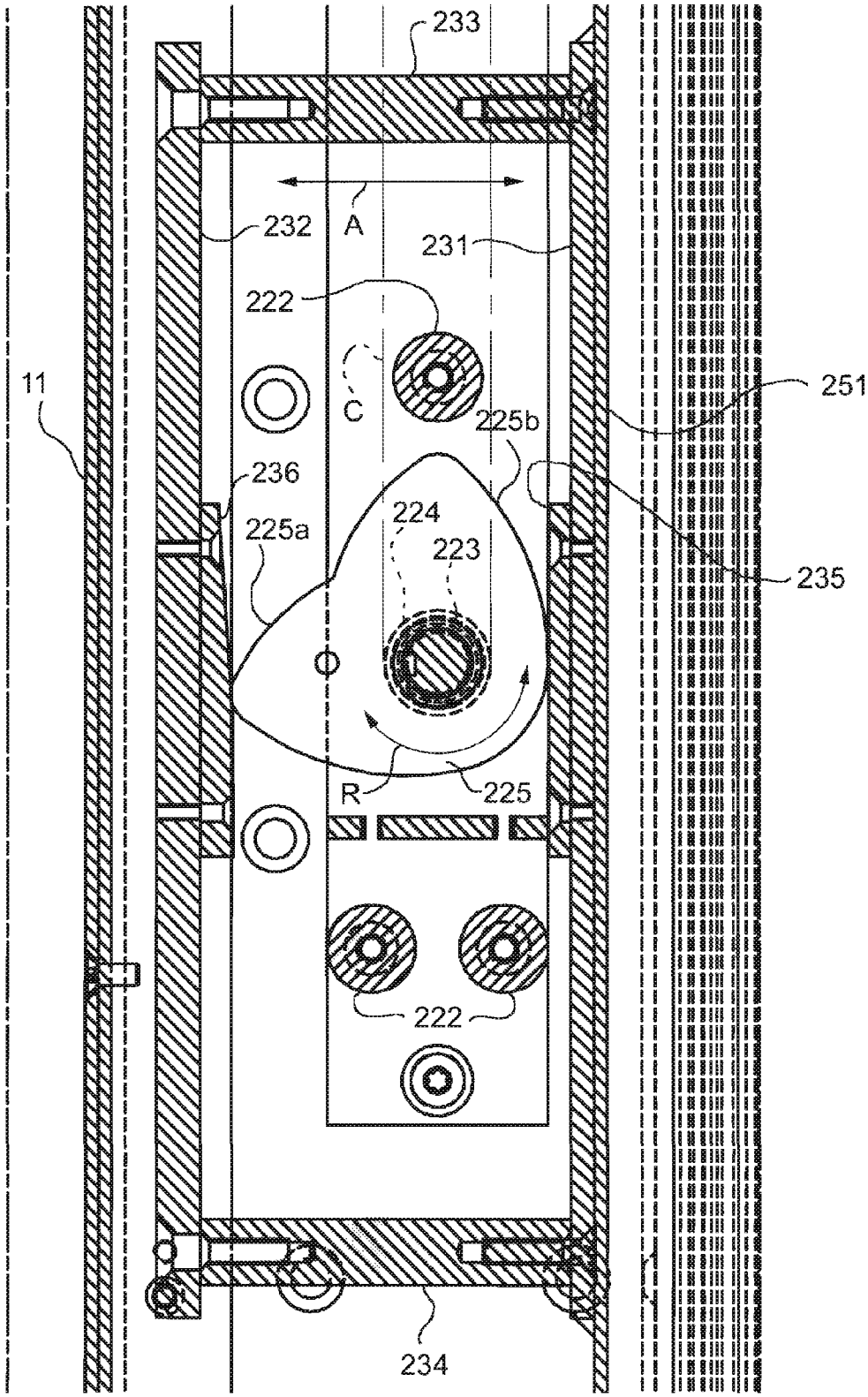
FIG. 8 is a sectional view of part of the detail of FIG. 4.

FIG. 7 shows in greater detail one of these driving devices 220, particularly the upper one. The driving device 220 substantially comprises a support plate 221, which is connected in a fixed way to the upright 11, by means of connecting columns 222. A rotatable shaft 223 is fitted to this support plate 221. FIG. 8 shows a vertical cross section parallel to the support plate 221 at the position of the lower driving device 220, whose arrangement is a mirror image of that of the upper driving device 220 shown in FIG. 7. As shown in FIG. 8, a sprocket 224 is keyed to the shaft 223 and is connected to one of the sprockets 214 of the operating device 210 by means of the corresponding chain transmission member C (indicated by a broken line), and a disc cam 225. This disc cam 225 is heart-shaped, and has a pair of lobes or appendages 225*a*, 225*b*.

With further reference to FIGS. 7 and 8, the driving device 220 also comprises a slide member 230. This slide member has a rectangular frame structure, comprising a pair of vertical elements 231, 232, which are interconnected at their ends by cross-members 233, 234. Each of the vertical elements 231, 232 is fixed to a corresponding cam follower 235, 236, designed to interact with the disc cam 225 in such a way as to convert the rotary motion of this cam 225, indicated by the arrow R, to a reciprocating linear motion of the slide member 230, indicated by the arrow A.

The slide members 230, each of which is associated with the corresponding corner of the main frame 10, are fixed to a sealing counter-frame 250 which is housed within the box structure of the main frame 10. This sealing counter-frame 250 extends along the whole perimeter of the main frame 10, and therefore comprises a pair of uprights and a pair of cross-members, which interconnect the uprights at their opposite ends. FIG. 7 shows a portion of one of the uprights, indicated by 251, and a portion of one of the cross-members, indicated by 253. The sealing counter-frame 250 is fitted within the main frame 10 in such a way that it can only have the reciprocating linear motion A produced by the disc cam 225, in other words a movement perpendicular to the plane defined by the main frame 10.

Figure 9:
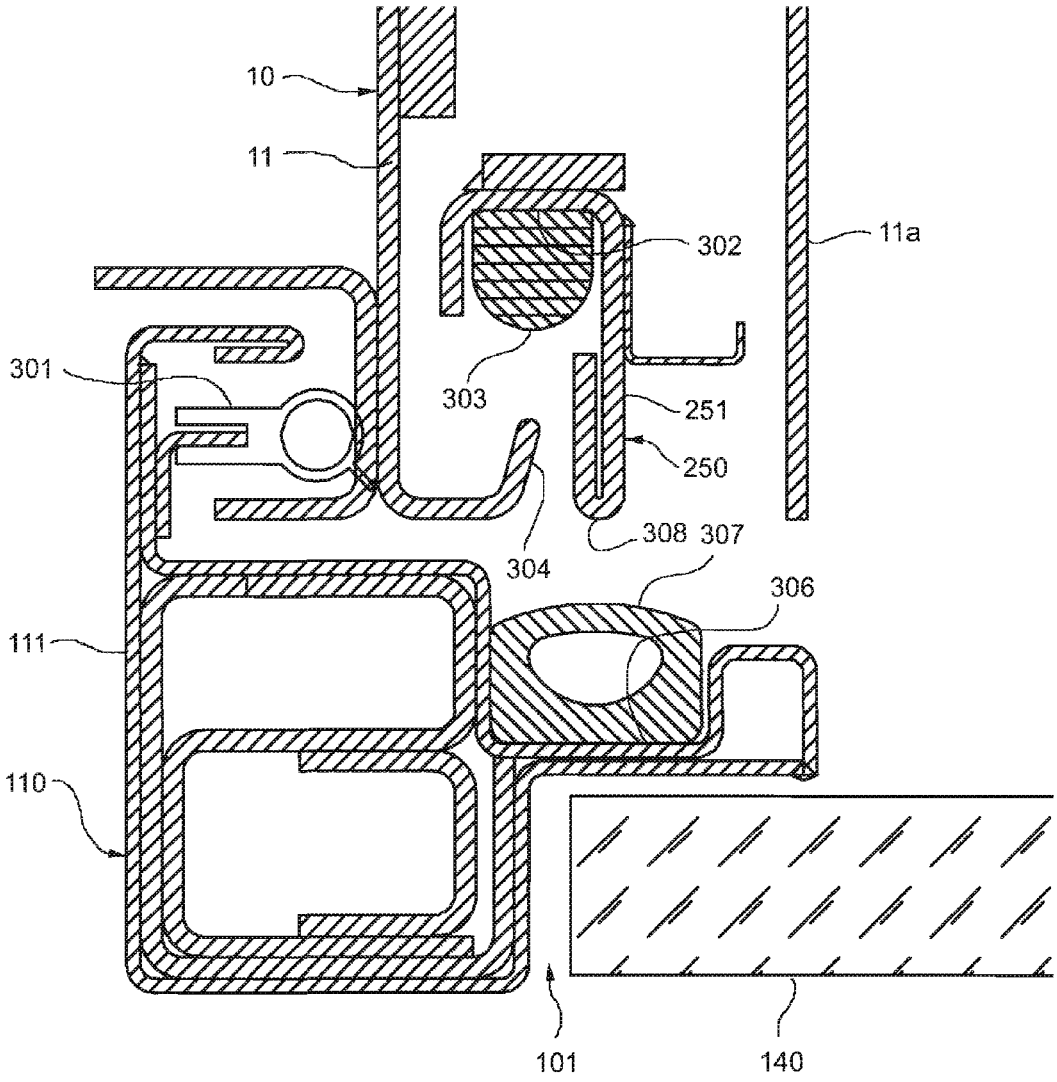
FIG. 9 is a sectional view of a detail of the door frame of FIG. 2, taken along the line IX-IX of the latter figure, in a disabled position of the watertight sealing mechanism.
Figure 10:
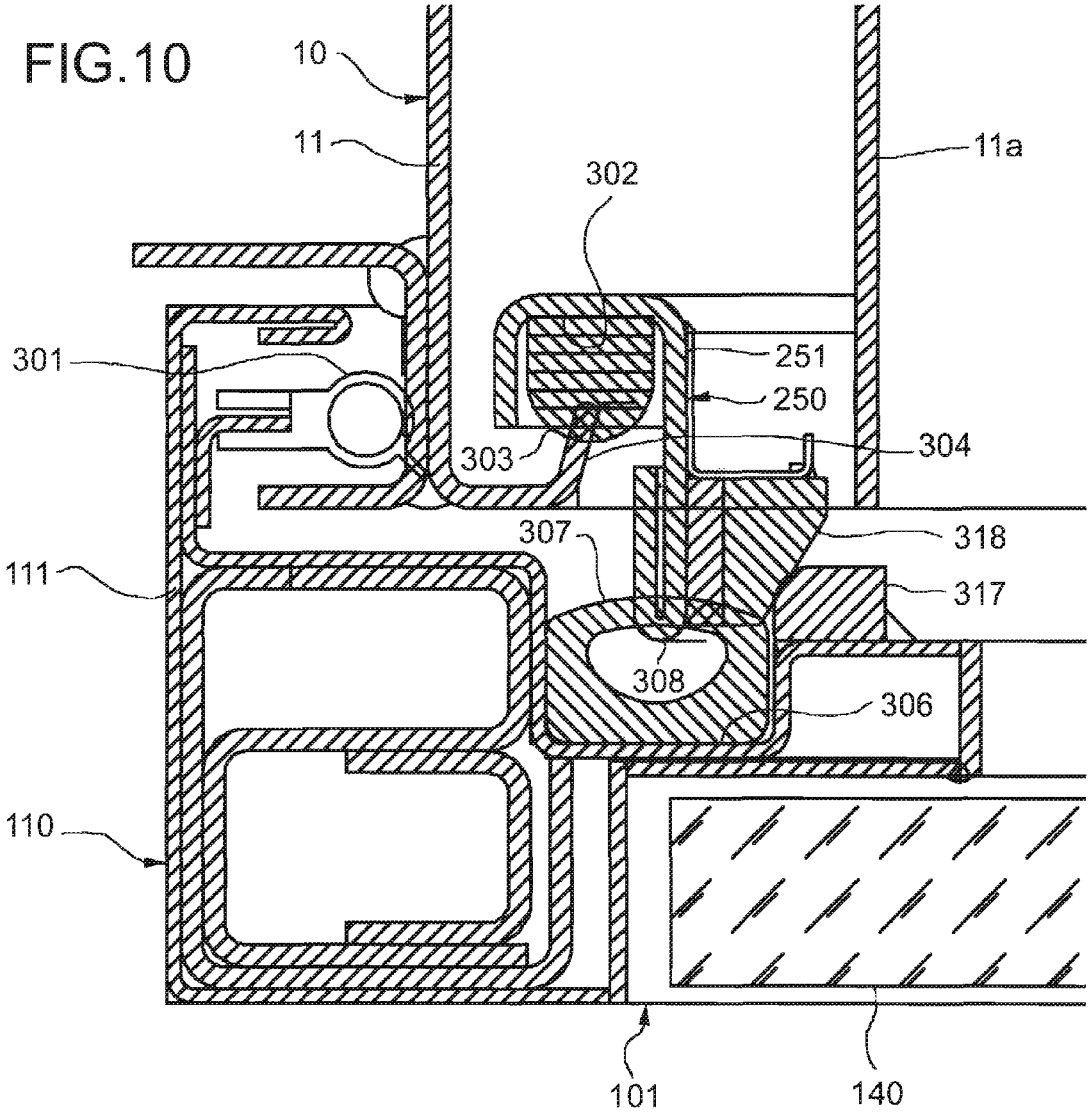
FIG. 10 is a sectional view of a detail of the door frame of FIG. 2, taken along the line X-X of the latter figure, in an activated position of the watertight sealing mechanism.

The operating principle of the watertight sealing mechanism 200 according to the invention will now be explained with reference to FIGS. 9 and 10. In particular, FIG. 9 shows a horizontal cross section taken along the line IX-IX of FIG. 2, in a condition in which the watertight sealing mechanism 200 is disabled, while FIG. 10 shows a horizontal cross section taken along the line X-X of FIG. 2, in a condition in which the watertight sealing mechanism 200 is activated. In these figures it can be seen that the wing 101 is closed on to the main frame 10, and that the upright 111 of the wing 101 has a gasket 301 of a conventional type, positioned in such a way as to extend along this upright 111. The gasket 301 is positioned in such a way that, in the closed condition of the wing shown in the figures, this gasket 301 is compressed between a surface of the upright 111 of the wing 110 and a corresponding surface of the upright 11 of the main frame 10.

FIGS. 9 and 10 also show that the main frame 10 has a box section which is incompletely closed in that it has a perimetric slit facing the side in which the wings 101 are fitted, thus allowing the sealing counter-frame 250 to emerge.

FIGS. 9 and 10 also show a cross section of the upright 251 of the sealing counter-frame 250. It can therefore be seen that the sealing counter-frame 250 has a channel 302, which extends along the whole perimeter of the counter-frame 250, and which houses a gasket 303, which extends along the whole perimeter of the channel 302. It can also be seen that the main frame 10 has a flange portion 304 which extends along the whole perimeter of the main frame 10 and faces the gasket 303 of the sealing counter-frame 250.

The secondary frames 110 of the wings 101 have corresponding channels 306, each of which extends along the cross-members 113, 114 and along one of the uprights 111, 112 of the frame 110 of the corresponding wing 101. Each of these channels 306 contains a corresponding gasket 307, which extends along the whole length of this channel 306. It can also been seen that the sealing counter-frame 250 has a backward folded edge portion 308, which extends along the whole perimeter of the sealing counter-frame 250 and faces the gaskets 306 of the secondary frames 110 of the wings 101.

As shown in FIGS. 7 and 10, in the proximity of the corners the secondary frames 110 of the wings 101 and the sealing counter-frame 250 have corresponding sealing elements 317, 318, which are designed to engage with each other in the activated condition of the watertight sealing mechanism 200, shown in FIG. 10.

Figure 11:
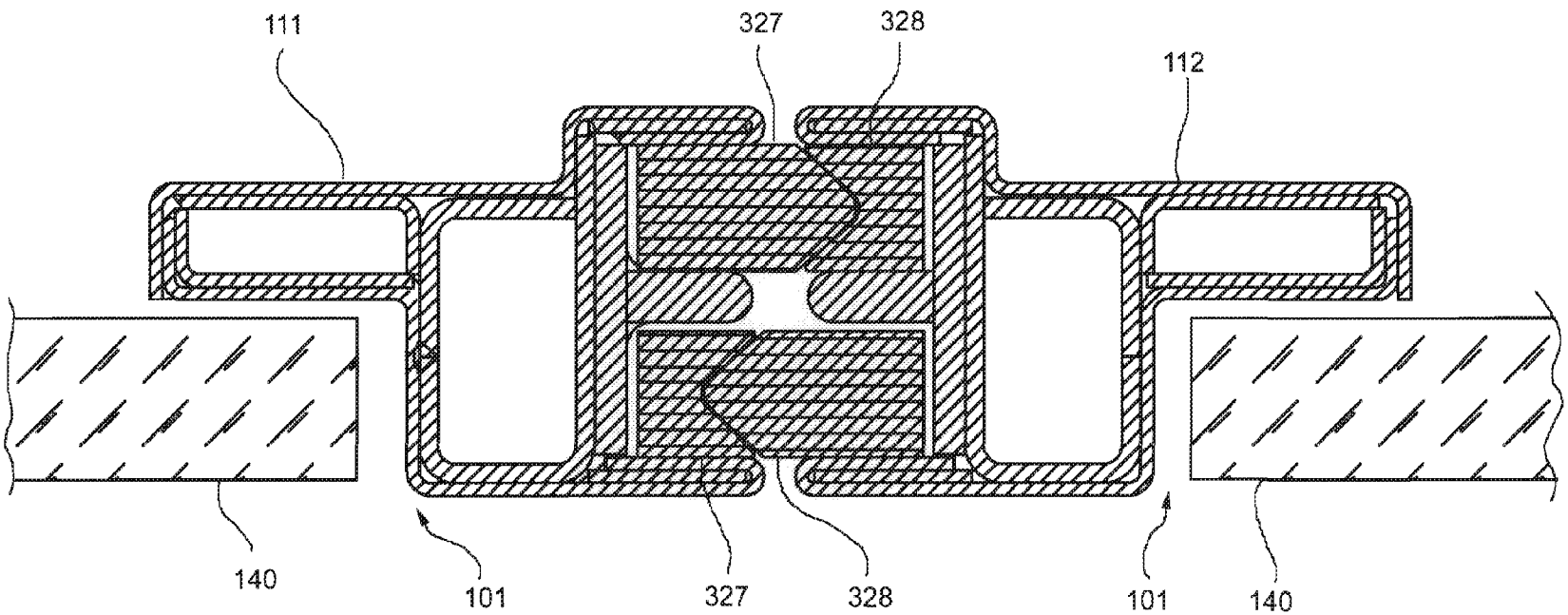
FIG. 11 is a sectional view of a detail of the door frame of FIG. 1, taken along the line XI-XI of the latter figure.

FIG. 11 shows a section through the edges of the wings 101 in contact with each other in the closed condition of the wings 101. It can be seen in this figure that the upright 111 of the wing shown on the left and the upright 112 of the wing shown on the right have corresponding gaskets 327, 328, which engage with each other so as to form a seal along the line of closure of the wings 101.

In the closed condition of the wings 101, a partial seal of a conventional type is formed by means of the gaskets 301 compressed between the uprights of the wings 101 and the uprights 11, 12 of the main frame, and by means of the gaskets 327, 328 compressed between the uprights of the wings 101. These gaskets are compressed as a result of the closed condition of the wings 101.

If it is desired to increase the overall sealing of the door 1, the operating device 210 must be activated by means of the appropriate activating key which is inserted into the recess 214 of the rotatable member 213. When this key is rotated in the clockwise direction, this causes the clockwise rotation (with reference to the arrangement shown in FIG. 5) of the rotatable member 213 of the activating device 210, which, by means of its sprockets 214, the chain transmission members C and the sprockets 224 of the driving devices 220 at the ends of the upright 11, causes the clockwise rotation (with reference to the arrangement shown in FIG. 8) of the disc cams 225 of the corresponding driving devices 220. The disc cams 225 rotate, thus causing their lobes 225*b* to engage with the corresponding followers 235 of the slide members 230 positioned on the side closer to the wings 101. The slide members 230 are therefore pushed in the direction of the arrow A pointing towards the wings 101, and consequently the sealing counter-frame 250, fixed to the slide members 230, is also pushed towards the wings 101. This counter-frame 250 is therefore moved from the position shown in FIG. 9 to the activated position shown in FIG. 10, in which the gasket 303 of the sealing counter-frame 250 is compressed against the flange portion 304 of the main frame 10, and the gaskets 307 of the wings 101 are compressed against the backward folded edge portion 308 of the sealing counter-frame 250. A watertight seal is thus formed along the perimeter of the wings 101. The configuration of the disc cams 225 and of the corresponding followers 235 is such that the sealing mechanism is locked in the activated position, in order to prevent its involuntary disabling.

To disable this mechanism, the key must be re-inserted into the recess 214 of the rotatable member 213. When this key is rotated in the anticlockwise direction, this causes the anticlockwise rotation (with reference to the arrangement shown in FIG. 5) of the rotatable member 213 of the operating device 210, which, by means of its sprockets 214, the chain transmission members C and the sprockets 224 of the driving devices 220 at the ends of the upright 11, causes the anticlockwise rotation (with reference to the arrangement shown in FIG. 8) of the disc cams 225 of the corresponding driving devices 220. The disc cams 225 rotate, thus causing their lobes 225*a* to engage with the corresponding followers 236 of the slide members 230 positioned on the side farther from the wings 101. The slide members 230 are therefore pushed in the direction of the arrow A pointing away from the wings 101, and consequently the sealing counter-frame 250, fixed to the slide members 230, is also moved away from the wings 101. This counter-frame 250 is therefore moved back from the position shown in FIG. 10 to the disabled position shown in FIG. 9. The configuration of the disc cams 225 and of the corresponding followers 236 is such that the sealing mechanism is locked in the disabled position.

Clearly, the present invention is not limited to the type of door illustrated, but can theoretically be applied to any type of door or window. Furthermore, provided that the principle of the invention is retained, the details of construction and the forms of embodiment can be varied widely from those described and illustrated, without departure from the scope of the invention. For example, the activation of the sealing mechanism can be different from that described herein, and can be not only manual, but also automated. It is also possible to provide sensor devices to detect the activated condition of the sealing mechanism.

The invention claimed is:

1. Door or window comprising a main frame and at least one wing fitted movably to said main frame, in such a way that said door or window can assume an open condition and a closed condition, and sealing means, positioned in such a way that they are interposed between said main frame and wing when the door or window is in the closed condition, wherein said sealing means comprise at least one gasket extending along at least part of the perimeter of said main frame and a movable sealing member supported movably by one of said main frame and wing, and capable of exerting a compressive force on said gasket against the other of said main frame and wing when said door or window is in the closed condition, said sealing means comprising operating means for making said movable sealing member move between an activated position, in which said movable member exerts said compressive force on the gasket with the door or window in the closed condition, and a disabled condition, in which said movable member removes said compressive force from the gasket with the door or window in the closed condition, wherein said movable sealing member comprises a sealing counter-frame which extends along the whole perimeter of said main frame and is fitted to said main frame in such a way as to be movable with respect to both wing and main frame when said door or window is in the closed condition, in a direction perpendicular to a plane parallel to the door or window defined by the main frame.

2. Door or window according to claim 1, in which said operating means include driving means comprising at least one disc cam, fitted rotatably on said main frame, and a corresponding pair of opposing cam followers, which can be engaged alternately by said disc cam in such a way as to define, respectively, said activated position and said disabled position of the movable sealing member.

3. Door or window according to claim 2, in which said operating means include a manually operated device connected for operation to said disc cam by transmission means.

4. Door or window according to claim 1, in which said door or window includes a watertight door for a ship.

* * * * *